US007503251B2

(12) United States Patent
Kawaguchi et al.

(10) Patent No.: US 7,503,251 B2
(45) Date of Patent: Mar. 17, 2009

(54) LOAD BALANCE ADJUSTING METHOD AND EQUIPMENT OF LIFTING JACKS, AND JACK-UP EQUIPMENT

(75) Inventors: Shigeyoshi Kawaguchi, Chiyoda-ku (JP); Yuuji Takahashi, Chiyoda-ku (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 349 days.

(21) Appl. No.: 11/293,172

(22) Filed: Dec. 5, 2005

(65) Prior Publication Data

US 2007/0074627 A1 Apr. 5, 2007

(30) Foreign Application Priority Data

Sep. 30, 2005 (JP) ..... 2005-287052

(51) Int. Cl.
*F15B 11/028* (2006.01)
*B66F 7/20* (2006.01)

(52) U.S. Cl. ..... 91/512; 254/89 H

(58) Field of Classification Search ..... 91/173, 91/512; 92/51, 62; 254/89 H
See application file for complete search history.

(56) References Cited

U.S. PATENT DOCUMENTS 3,556,480 A * 1/1971 Johansson ..... 254/89 H
3,638,535 A * 2/1972 Ponter ..... 91/171
3,703,849 A * 11/1972 Renner et al. ..... 91/512

FOREIGN PATENT DOCUMENTS

JP A-07-101686 4/1995
JP A-07-113330 5/1995
JP A-09-278389 10/1997

* cited by examiner

*Primary Examiner*—F. Daniel Lopez
(74) *Attorney, Agent, or Firm*—Oliff & Berridge, PLC

(57) ABSTRACT

A load balance is adjusted to be appropriate even if shared loads of lifting jacks are fluctuated from an initial setting state caused by cumulative errors of suspending rods. It is a load balance adjusting method of the lifting jack when a lifting module is jacked up by the plural lifting jacks via the suspending rods. The shared loads of the lifting jacks jacking up the respective suspending rods coupled to the lifting module are detected. A height of the lifting jack is adjusted when a fluctuation relative to a setting shared load stored in advance exceeds a prescribed range, to thereby adjust to be the setting shared load.

7 Claims, 8 Drawing Sheets

LOAD BALANCE ADJUSTING METHOD AND EQUIPMENT OF LIFTING JACKS, AND JACK-UP EQUIPMENT

BACKGROUND OF THE INVENTION

1. Field of the Invention

The present invention relates to a load balance adjusting method and an equipment of a lifting jack, and a jack-up equipment, and to the load balance adjusting method and the equipment of the lifting jack, and the jack-up equipment suitable for raising/lowering a boiler module without disrupting the load balance when the boiler module of a large scale electric-power plant is raised/lowered by using plural lifting jacks using suspending rods.

2. Description of Related Art

In a thermal power station having large suspending type boilers, a main beam for supporting the boilers is provided at a top end portion of a steel frame to be a suspending fabric, and boiler components are supported in a state suspended by this main beam. For this construction, a lifting construction method is generally adopted. In this construction method, plural lifting jacks placed on a supporting beam such as a temporary beam or the main beam are used, attendant parts are assembled while a module being the boiler component is lifted from the ground by using the lifting jacks, and finally, it is suspended and supported by the main beam at dozens of meters upward from the ground by using a sling rod and so on. Such works are performed repeatedly by each module from the module assembled at an upper portion of the boiler to the module assembled at a lower portion of the boiler sequentially to thereby build a whole boiler facility.

As shown in FIG. 5, steel columns 12 are placed around a boiler module 10 being a massive structure, and a temporary beam 14 is provided at an upper portion of these steel columns 12. Center hole type lifting jacks 16 are arranged on this temporary beam 14, and suspending rods 18 attaching the boiler module 10 at lower ends thereof are supported.

As shown in FIG. 6, the above-stated suspending rod 18 has a configuration in which short single rods 18S are coupled by screwing each other in an axial direction to be elongated. A structure of the single rod 18S is the one that a head portion 22 having a slightly large-diameter is formed at an upper end portion of a rod portion 20, a female screw portion 24 is formed at a top end surface of the head portion, and a male screw portion 26 is formed at a lower end of the rod portion 20. A piece of long suspending rod 18 is formed by continuously connecting respective single rods 18S in a screwed coupling with each other, and a jacking-up is enabled by using the head portion 22 of the single rod 18S.

The center hole type lifting jack 16 raising/lowering such suspending rod 18 is suspending and raising/lowering the boiler module 10 with hanging and supporting in a state penetrating the above-stated suspending rod 18 into a center hole 28 opened in longitudinal directions. This structure is shown in FIG. 7.

Namely, in the center hole type lifting jack 16, a cylindrical ram 32 driven by a hydraulic pressure is disposed inside of a cylinder 30, an upper chuck 34 and a lower chuck 36 sliding in an orthogonal direction with an axis of the suspending rod 18 are provided at an upper portion of the ram 32 and at a lower portion of the cylinder 30, and the suspending rod 18 is supported and pushed upward by these chucks 34, 36 to thereby jack up the boiler module 10.

As shown in FIG. 8, a procedure of the jacking-up is as follows: at first, the suspending rod 18 suspending the boiler module 10 is supported by the upper chuck 34 (supporting rod No. 2); a load of the boiler module 10 is received by the upper chuck 34 (first stage). Next, the lower chuck 36 is released. The ram 32 is actuated in this state, the suspending rod 18 is pushed up for the length of the single rod 18S, and the boiler module 10 is jacked up via the suspending rod 18 (second stage). Next, the lower chuck 36 is closed at a position the suspending rod 18 raises for one rod (third stage). The ram 32 is lowered to transfer a supporting portion to a supporting rod No. 5 by the lower chuck 36, and the load of the lifting (suspending load) is received via the corresponding supporting rod No. 5. When the lower chuck 36 supports the suspending rod 18, the upper chuck 34 is released to further lower the ram 32 (fourth stage). When the suspending rod 18 comes to below a neck portion of a supporting rod No. 3 positioning one lower of the supporting rod No. 2 supported by the upper chuck 34 until that time, the upper chuck 34 is closed again to support the suspending rod 18 by the upper chuck 34, then the lower chuck 36 is released, and the above-stated operation is repeated. As stated above, when a coupling position of the suspending rods 18 with each other comes up to an upper portion of the center hole type lifting jack 16, the single rod 18S at the upper portion is detached. These first to fourth stages are repeated sequentially, and the boiler module 10 is jacked up while retrieving the single rods 18S from an upper end portion.

By the way, when the above-stated boiler module 10 is raised/lowered by the center hole type lifting jack 16, it is performed by using plural center hole type lifting jacks 16. It depends on a module weight, but for example, a module of 3000 tons to 4000 tons is lifted by using twenty or more center hole type lifting jacks 16 whose self-loading is 200 tons. Consequently, it is necessary to make a raising/lowering drive while averaging the loads of the twenty center hole type lifting jacks 16. When one boiler module 10 is jacked up by plural number of lifting jacks, for example, ten jacks for one line are provided two lines to perform a jack-up. Generally, the loads shared by respective jack lines are different with each other, but the loads shared by the jacks within the same line are set to be averaged, and it is necessary that the loads are not fluctuated from an initial shared load. If a load balance is fluctuated, a problem may occur such that an excessive load is added to a single jack and so on. Generally, a connection length of the boiler module 10 and the suspending rod 18 is adjusted so that the shared loads of the respective center hole type lifting jacks 16 within the same line are to be equal in an initial state when the boiler module 10 is lifted up from the ground first.

However, when the boiler module 10 is lifted while detaching the single rods sequentially from the upper end of the suspending rod 18 from an initial setting state, a length of the whole suspending rod becomes short. As a result, there is a problem that the shared loads are fluctuated from an initial value which is set so that the shared loads of the respective center hole type lifting jacks 16 are averaged, caused by a connection cumulative error of the suspending rod. Conventionally, it is impossible to adjust such fluctuation of the shared load in the middle of the lifting.

Besides, the loads imposed by the respective center hole type lifting jacks 16 are asked from a pressure of an operating oil supplied inside of the jacks. However, there is a problem that a detection value may be dispersed even if a supplied pressure of the operating oil during the actuation of the jack-up is detected. Namely, there is a problem that an accurate detection can not be performed because a dynamic pressure is detected.

SUMMARY OF THE INVENTION

The present invention has an eye on the above-stated conventional problems, and the object thereof is to provide a method and an equipment which can adjust a load balance to be appropriate even if shared loads of the lifting jacks fluctuate from an initial setting state by a cumulative error of suspending rods during a process of lifting from an initial state in which a module is lifted up from the ground when a boiler module is lifted by using plural center hole type lifting jacks, and to provide a jack-up equipment capable of adjusting a balance. Besides, the object thereof is to provide a jack-up equipment capable of detecting a static pressure of the shared loads of the respective lifting jacks to make an adjustment of a setting of the shared loads quickly and accurately.

To attain the above-stated objects, a load balance adjusting method of lifting jacks, when a lifting module is jacked up by plural lifting jacks via suspending rods, comprising: detecting shared loads of the lifting jacks jacking up respective suspending rods coupled to the lifting module; and adjusting a height of the lifting jack when a fluctuation of the detected shared load relative to a setting shared load exceeds a prescribed range, to adjust to be the setting shared load.

A load balance adjusting equipment of a lifting jack, when a lifting module is jacked up by using plural lifting jacks via suspending rods, including: an adjusting jack capable of adjusting an installation height of each lifting jack independently; a load detecting means detecting a lifting load of the lifting jack by a hydraulic force of the adjusting jack; and a control means capable of adjusting a height of the lifting jack by the adjusting jack based on a setting shared load and a detected load of the lifting jack.

Further, a jack-up equipment, including: a height-adjusting jack of a center hole type capable of changing an installation height of a lifting jack at a lower portion of the lifting jack of the center hole type jacking up a lifting module via a suspending rod; a detecting means of a pressure of a hydraulic chamber inside of the height-adjusting jack; and a supplying/draining means of a pressure oil, and wherein a height adjustment of the lifting jack is enabled by a raising/lowering of the height-adjusting jack by the supplying/draining means of the pressure oil based on a detected hydraulic pressure.

In the present invention, the height-adjusting jack is provided at a lower portion of the lifting jack to perform a supplying/draining of an operating oil, and thereby, an installation height of the lifting jack can be changed without acting on a supplying control of the pressure of the operating oil of the lifting jack. In particular, a pressure of a hydraulic chamber of the height-adjusting jack is detected to thereby detect an imposed load added to the lifting jack at an upper portion. This imposed load of the lifting jack can be detected as a stable pressure, and therefore, a detected value may not be varied.

Further, in the present invention, when the module is lifted up by using the plural lifting jacks, the imposed load is asked in the stable pressure by a load detecting means provided at the height-adjusting jack, and a difference with a set shared load is checked, and the installation height of the lifting jack in itself can be adjusted so that the difference falls, for example, within 15%. A load balance of the whole lifting jacks can be adjusted by performing the adjustment as stated-above by every plural lifting jack.

DETAILED DESCRIPTION OF THE PREFERRED EMBODIMENTS

Hereinafter, concrete embodiments of a load balance adjusting method and an equipment of a lifting jack, and a jack-up equipment according to the present invention will be explained in detail with reference to the drawings.

Figure 1:
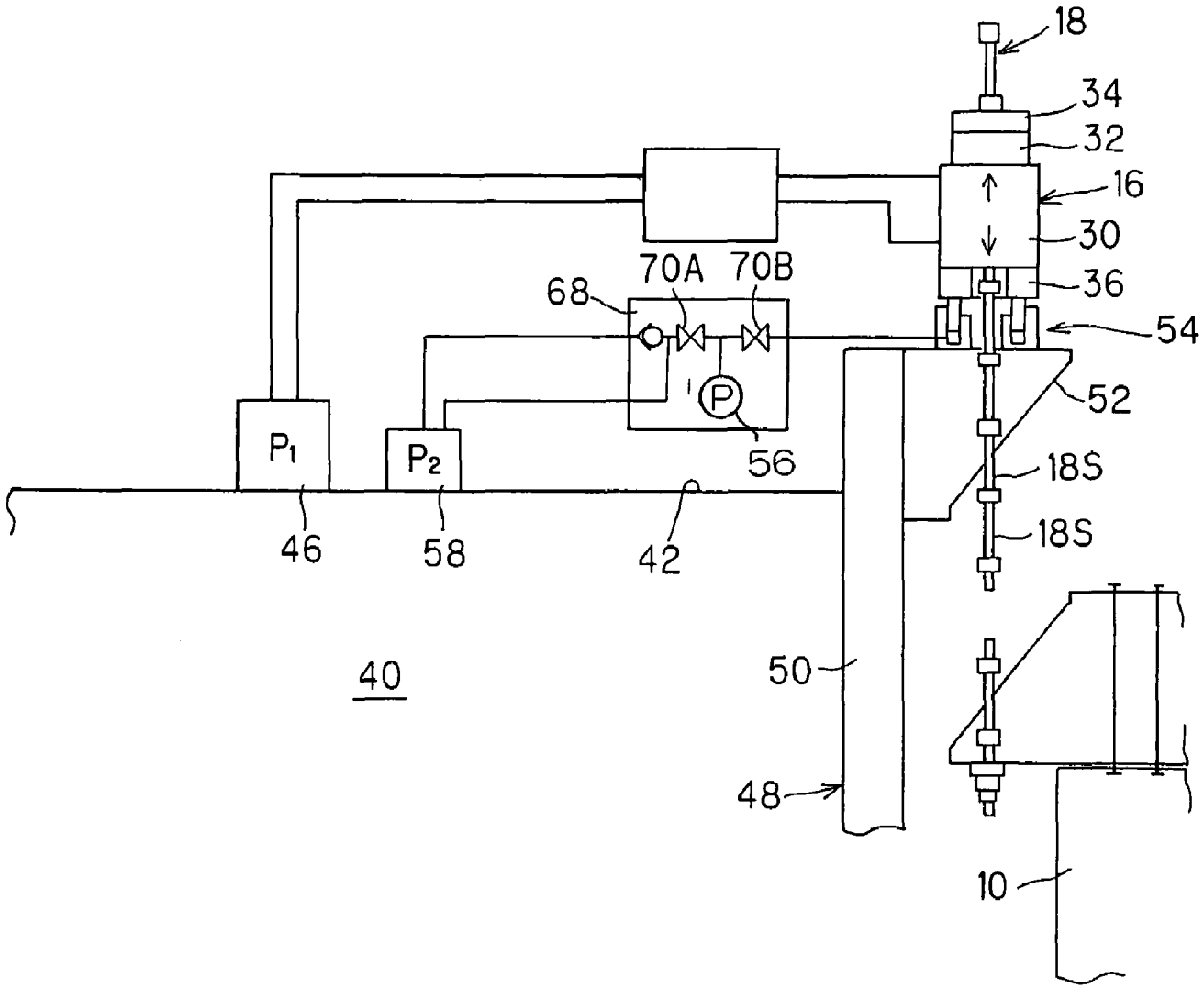
FIG. 1 is an explanatory view of a lifting up state of a boiler module 10 using a jack-up equipment according to an embodiment.

FIG. 1 is an explanatory view of a lifting up state of a boiler module 10 using a jack-up equipment according to an embodiment. In FIG. 1, a work floor 42 is formed at an upper portion of a boiler steel 40 composing a boiler chamber, and a first hydraulic unit 46 to drive control boards and center hole type lifting jacks 16 is placed on this work floor 42. A boiler side steel frame 48 is provided to the boiler steel 40, and the boiler module 10 is raised/lowered by installing the center hole type lifting jack 16 on a jack base 52 provided at an upper end portion of a support post 50. Only one jack lifting and supporting one side of the boiler module 10 is shown in the drawing, but in the embodiment, eight center hole type lifting jacks 16 are arranged at one side, and the other one side which is not shown is also lifting and supported by eight center hole type lifting jacks 16.

Figure 6:
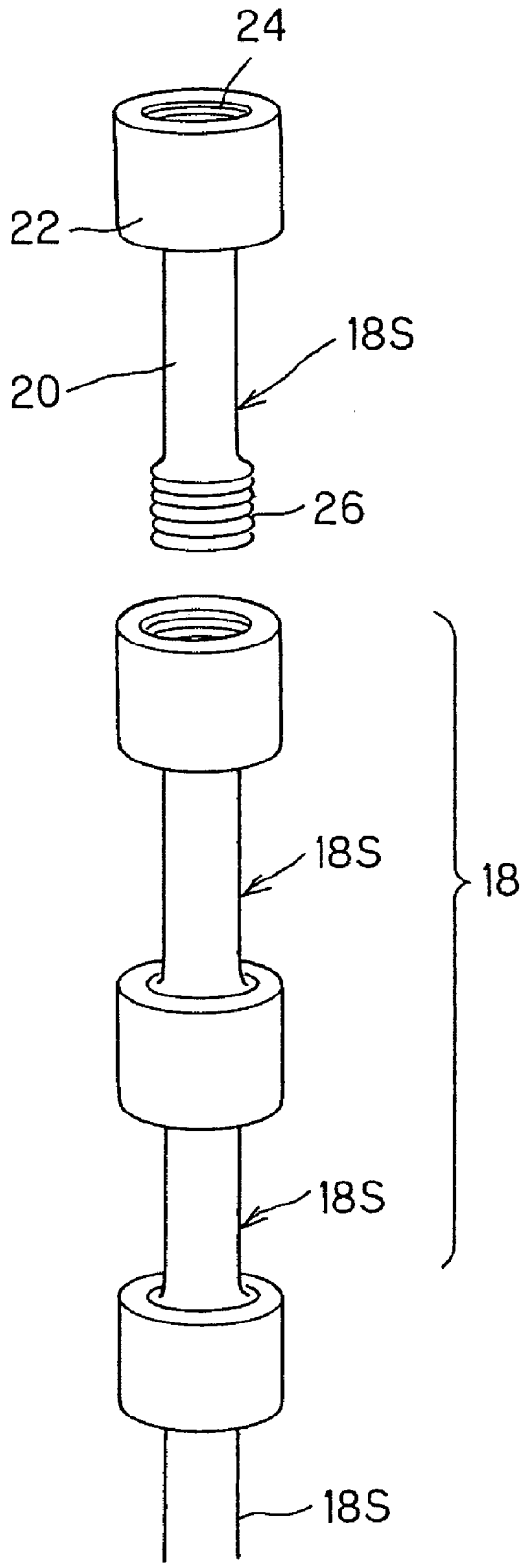
Fig. 6 Prior Art
FIG. 6 is an explanatory view of the suspending rod and a single rod.
Figure 7:
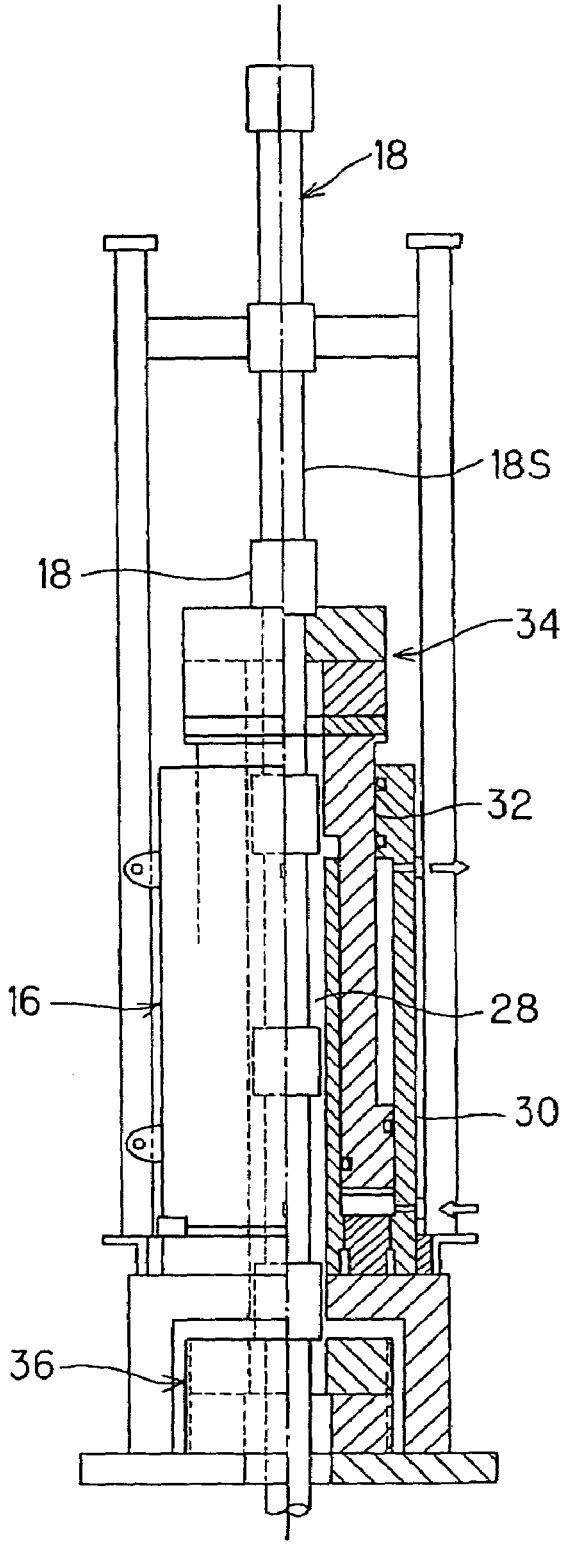
Fig. 7 Prior Art
FIG. 7 is a partial sectional view of a lifting jack.
Figure 8:
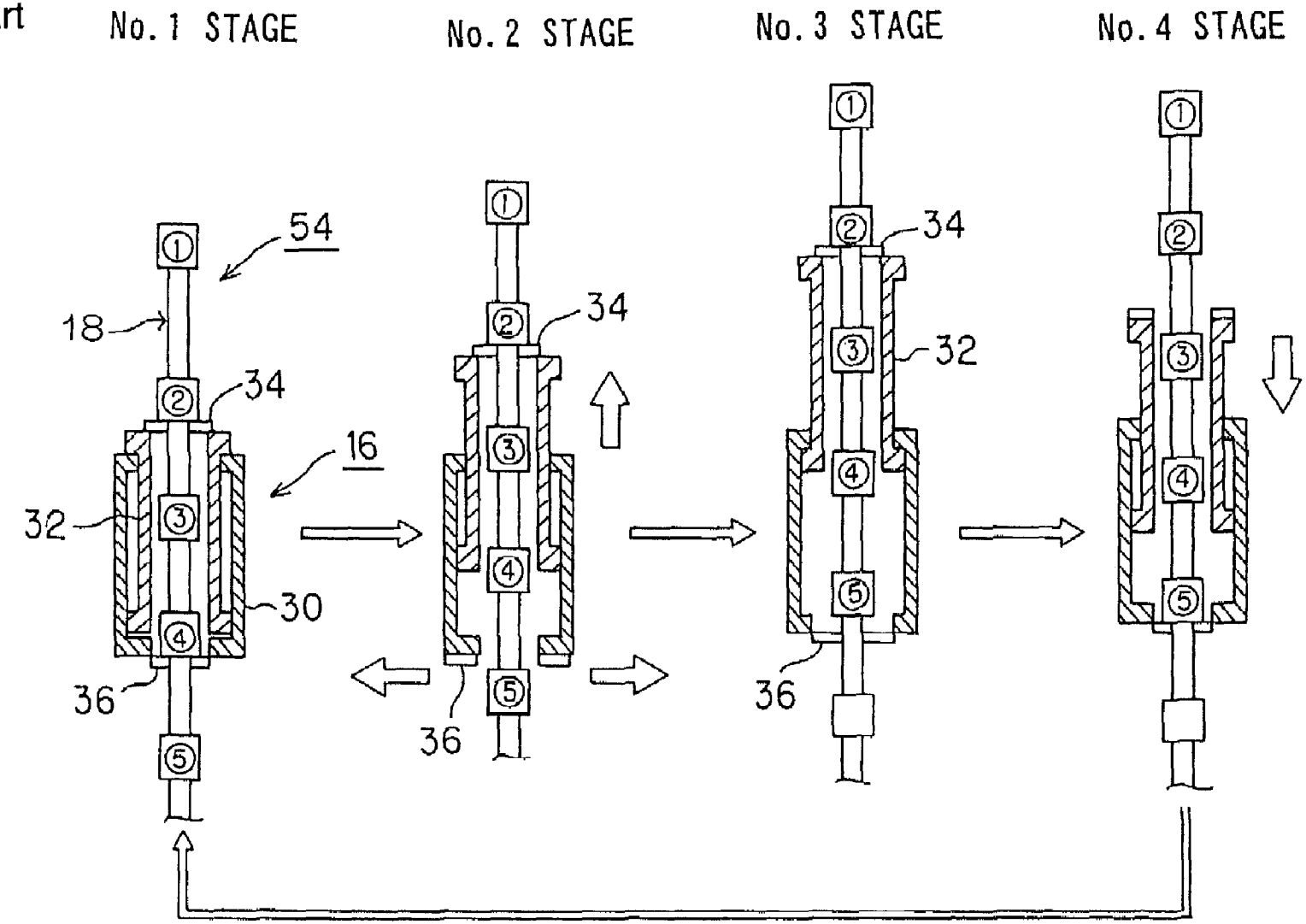
Fig. 8 Prior Art
FIG. 8 is an explanatory view of a jack-up process using the suspending rods.

The boiler module 10 is raised/lowered while supported by a suspending rod 18 (refer to FIG. 6) in which plural single rods 18S are coupled by screwing each other in an axial direction. The suspending rod 18 is penetrated into a center hole 28 of the above-stated center hole type lifting jack 16, and made a pitch move in a longitudinal direction by a longitudinal move of a ram 32 and actuations of chucks 34, 36 provided at upper and lower positions alternately.

By the way, in the present invention, a center hole type height-adjusting jack 54 capable of changing an installation height of the corresponding center hole type lifting jack 16 is provided, and a pressure detector 56 being a detecting means of a pressure of a hydraulic chamber inside of the height-adjusting jack, and a second hydraulic unit 58 being a pressure oil supplying and draining means are provided at a lower portion of the above-stated center hole type lifting jack 16, and the height adjustment of the above-stated center hole type lifting jack 16 is enabled by a raising/lowering of the height-adjusting jack 54 by the pressure detector 56 based on the detected hydraulic pressure.

Namely, the height-adjusting jack 54 is disposed between individual center hole type lifting jack 16 and the jack base 52 to be a concentric disposition with the above-stated lifting jack 16, and the corresponding height-adjusting jack 54 is raised/lowered to thereby enabling the adjustment of the installation height of the center hole type lifting jack 16 independently. Besides, it becomes possible to detect an actual value of a lifting load added to the center hole type lifting jack 16 as a static pressure by providing such height-adjusting jack 54.

Figure 2:
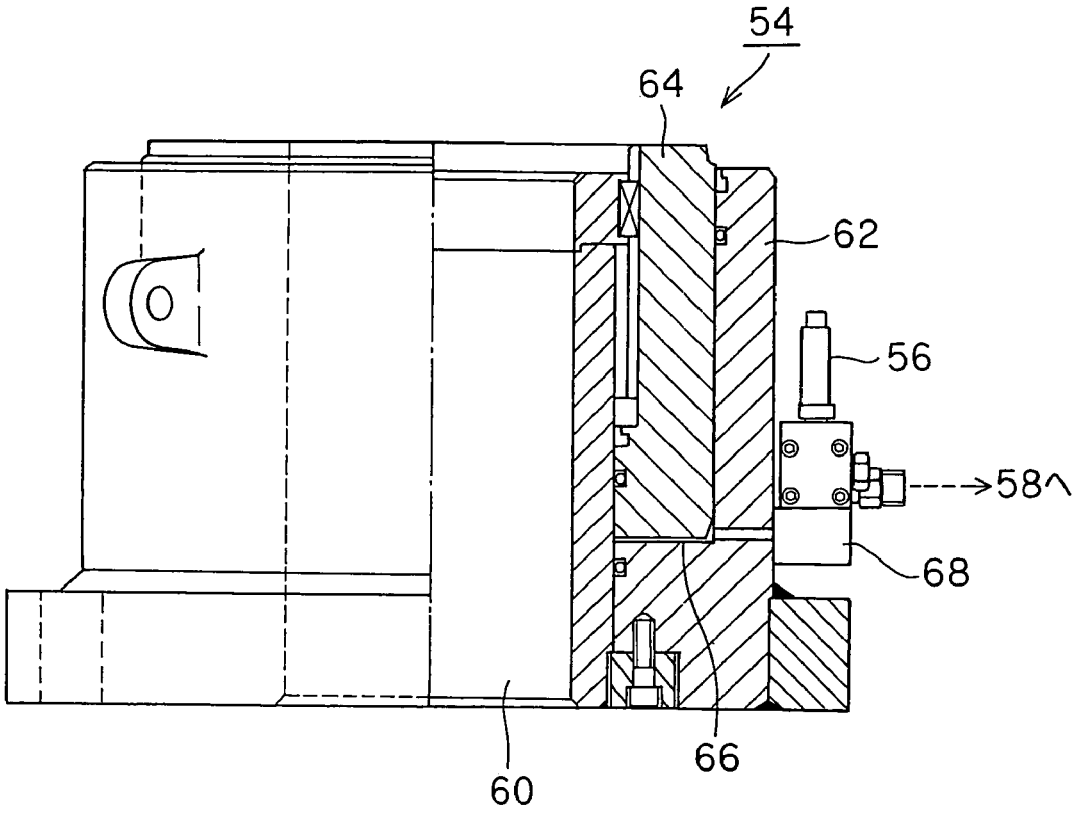
FIG. 2 is a partial sectional front view of a height-adjusting jack.

FIG. 2 is an actual partial sectional view of the height-adjusting jack 54. As shown in the drawing, this height-adjusting jack 54 has a ram cylinder 62 penetrating a center hole 60 in a longitudinal direction of a center portion, and it is constituted by attaching a ram 64 to this ram cylinder 62. A hydraulic chamber 66 is provided inside of the ram cylinder 62 accommodating the ram 64, and an operating oil is supplied/drained to/from this hydraulic chamber 66, and thereby the ram 64 is enabled to come in and out from an upper surface of the cylinder along an axial core direction of the center hole 60. A valve unit 68 is connected to a hydraulic passage leading to the hydraulic chamber 66. A circuit configuration of the valve unit 68 is, as shown in FIG. 1, a pair of gate valves 70 (70A, 70B) are provided at a pump path of the second hydraulic unit 58, and a return oil passage for a tank side of the second hydraulic unit 58 is provided between the gate valves 70.

Figure 3:
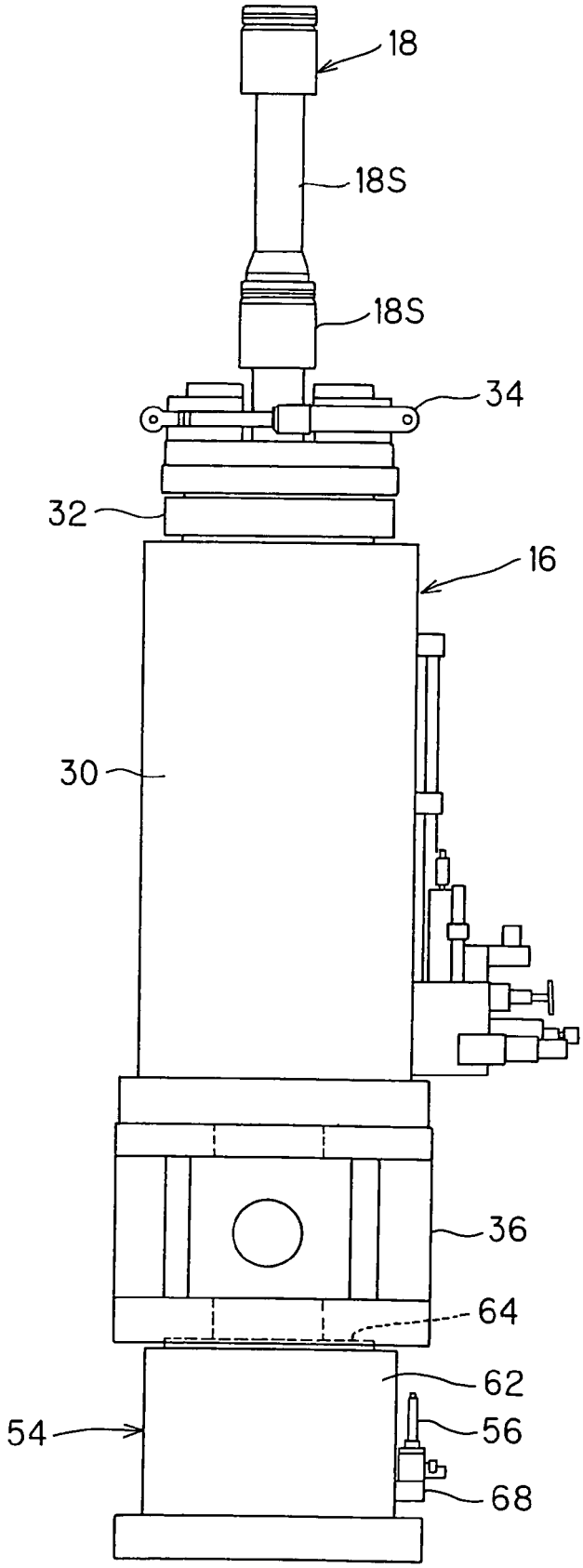
FIG. 3 is a front view of the jack-up equipment.

Such height-adjusting jack 54 is disposed at the lower portion of the individual center hole type lifting jack 16, and both integrally constitute a jack-up equipment. As shown in FIG. 3, the center hole type lifting jack 16 has a structure in which a cylinder 30 and the ram 32 comes in and out to/from the cylinder 30 are provided, the upper chuck 34 is disposed at an upper end portion of the ram 32 and the lower chuck 36 is disposed at a bottom surface portion of the cylinder 30, respectively. The height-adjusting jack 54 is interposed between the lower chuck 36 and the jack base 52, the center hole type lifting jack 16 is enabled to be pushed up by the ram 64, and thereby, it is possible to adjust the installation height of the center hole type lifting jack 16 relative to the jack base 52.

Figure 4:
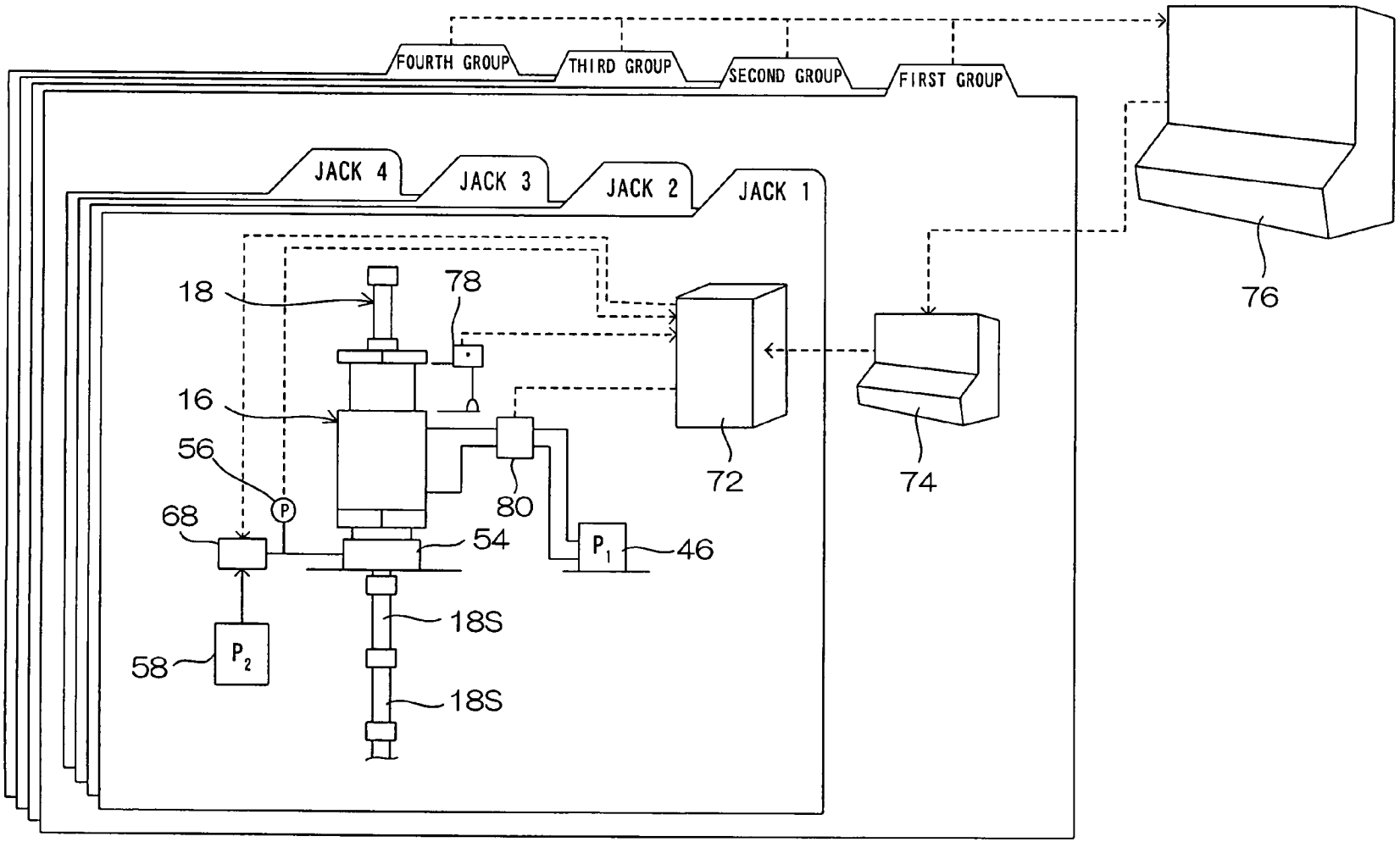
FIG. 4 is an entire configuration view of a control system using the height-adjusting jack.
Figure 5:
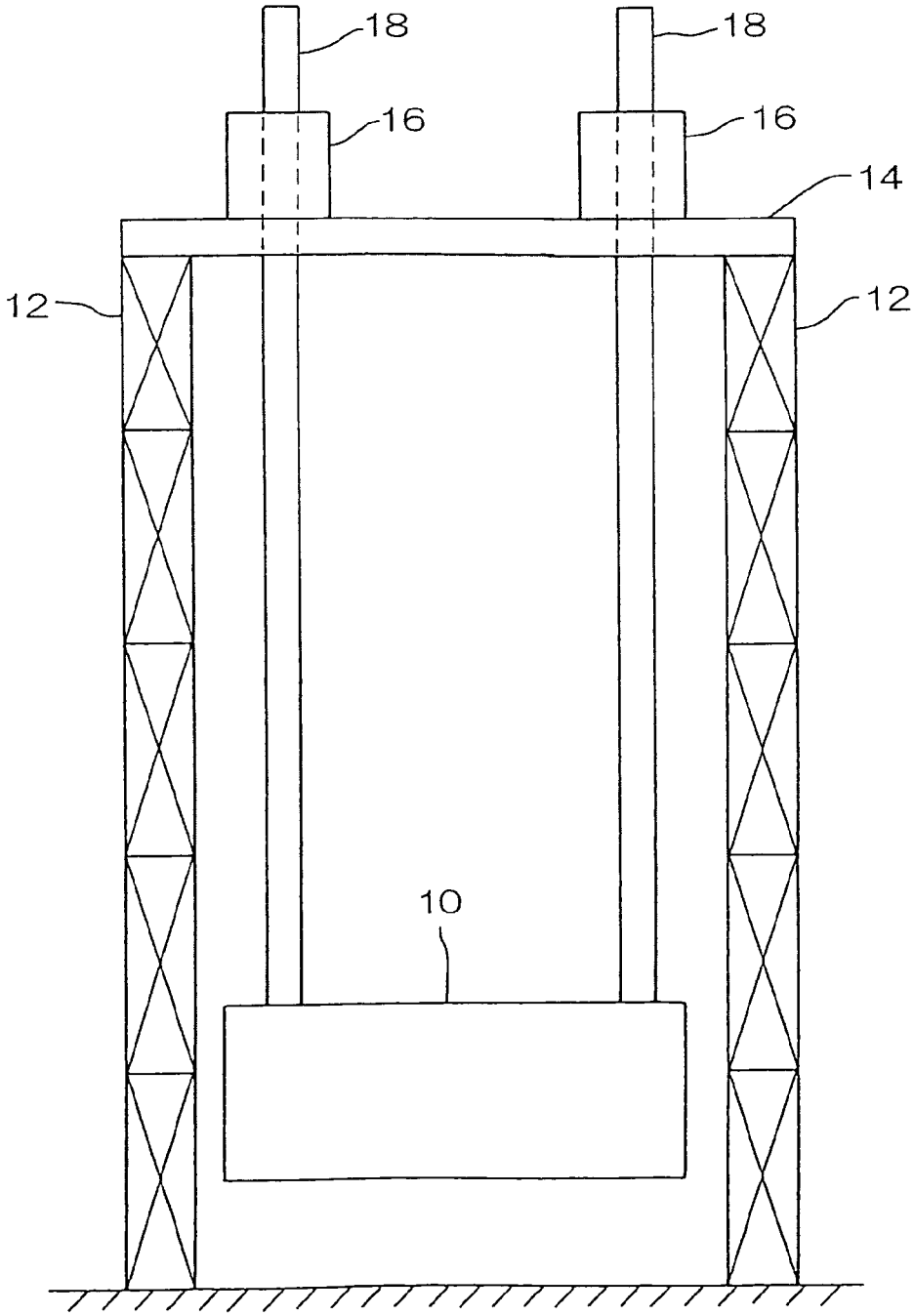
Fig. 5 Prior Art
FIG. 5 is an explanatory view of a lifting state of a boiler module by suspending rods.

FIG. 4 is showing an entire configuration of a control system using such height-adjusting jack 54. Sixteen of the above-stated jack-up equipments are used in the embodiment. They are divided into four groups in which four jack-up equipments arranged on the jack base 52 and having approximately equal shared loads are grouped into one group, and an equipment control board 72 performing a control and management of each jack-up equipment, a local control board 74 performing a control and management of each group, and a central control board 76 performing an overall control and management are included. The equipment control board 72 inputs a raising/lowering stroke signal of the center hole type lifting jack 16 from an encoder 78, and outputs a valve opening/closing signal for raising/lowering to a valve unit 68. At the same time, a signal from the pressure detector 56 at the height-adjusting jack 54 side is inputted, and a signal for height adjustment is outputted to the valve unit 68. The local control board 74 inputs/outputs control signals between the equipment control board 72 of one group, and the central control board 76 controls them integrally. Incidentally, in a group division of the jack-up equipments, it is not necessary to make the number of equipments equal, and the jack-up equipments having the same shared loads can be divided as one group.

In this embodiment, the load balance of the center hole type lifting jacks 16 is adjusted when the boiler module 10 to be lifted is jacked up by the plural center hole type lifting jacks 16 via the suspending rods 18. As stated above, the height-adjusting jack 54 capable of adjusting the installation height of the respective center hole type lifting jack 16 independently is provided, and a lifting load of the center hole type lifting jack 16 is detected by the pressure detector 56 as a hydraulic force added to the above-stated hydraulic chamber of the height-adjusting jack 54. This detected pressure is a pressure received by the ram 64 mounting the center hole type lifting jack 16, and therefore, it is a suspending load received by the center hole type lifting jack 16. It is necessary to slightly protrude the ram 64 of the height-adjusting jack 54 in advance so that the height-adjusting jack 54 generates the pressure. A detected signal of the pressure detector 56 is inputted to the central control board 76 via the equipment control board 72 and the local control board 74. Consequently, every shared load detected signal of the center hole type lifting jacks 16 under control are inputted to the central control board 76.

Meanwhile, shared load signals at an initial setting time is acquired to the central control board 76 in advance to store in a storage means. The shared load at the initial setting time is the shared load of a state in which the boiler module 10 is lifted up from a floor surface, namely an initial state at a stage lifted up from the ground. This is to store a value being adjusted so that the loads shared by the respective center hole type lifting jacks 16 are to be averaged, as a setting shared load when it is lifted up from the ground. At the first lift up from the ground, it is possible to set a coupling position of the boiler module 10 and the suspending rod 18 to average the shared load by adjusting a nut position and so on. The shared loads of the respective center hole type lifting jacks 16 may not be too much or too small if this state is kept during a lifting process. However, the suspending rod 18 becomes shorter in accordance with the lifting up, then the length of the suspending rod 18 by each center hole type lifting jack 16 is fluctuated influenced by an accumulation of errors in coupling by screwing of the single rods 18S with each other. Herewith, the shared load of the center hole type lifting jack 16 becomes deviated from the initial value. A difference between the setting shared load of the center hole type lifting jack 16 at initial time and the detected load obtained by the pressure detector 56 in the middle of lifting is therefore detected. The central control board 76 calculates the difference, transmits a supplying/draining signal of the operation oil to the height-adjusting jack 54, and the opening/closing signal to the valve unit 68 via the local control board 74 and the equipment control board 72, so that the detected shared load falls within a tolerance (for example, 15%) relative to the initial setting shared load, and adjust the height of the center hole type lifting jack 16 by moving in/out the ram 64 so that the shared load becomes to be the setting load. When the detected load of one center hole type lifting jack 16 is higher than the setting shared load, it means that the length of the suspending rod 18 becomes short, and therefore, it is controlled to lower the ram 64 of the height-adjusting jack 54. Herewith, the averaged shared load as same as the surrounding center hole type lifting jacks 16 becomes possible, and a coupling error of the suspending rod 18 can be absorbed.

As stated above, in the present embodiment, the shared loads of the center hole type lifting jacks 16 jacking up each suspending rod 18 coupled to the boiler module 10 are detected by the hydraulic forces of the height-adjusting jacks 54 provided at the lower portions thereof, the heights of the above-stated center hole type lifting jacks 16 are adjusted by the height-adjusting jacks 54 so as to be the setting shared load when the fluctuation relative to the initial setting shared load exceeds a prescribed range, and thereby, a fluctuation band can be controlled, for example, within 15%. The detected shared load of the center hole type lifting jack 16 is the pressure of the hydraulic chamber 66 of the height-adjusting jack 54, and therefore, it is possible to detect as the stable pressure. Consequently, the detected value does not vary, to obtain the value with high accuracy, and a controllability becomes good.

Concretely speaking, the height-adjusting jack 54 capable of extending for 100 mm in a stroke is attached below the center hole type lifting jack 16. Generally, a distance of approximately 500 mm each is jacked up by the plural center hole type lifting jacks 16 (for example, 16 lifting jacks). The suspending rod 18 is a joint type of the single rods 18S of approximately 500 mm, and when the load balance is checked at the time it is jacked up to the halfway height of, for example, 100 pieces of the single rods 18S become 40 pieces, the balance of each is getting out of order to some extent caused by the cumulative error of the suspending rod 18, and there may be a jack with a large load and a jack with a small load even if the loads are averaged at first to start the jack-up. A series of center hole type lifting jacks 16 have a pump in common, and therefore, the respective center hole type lifting jacks 16 in themselves are jacked up every 500 mm in the same way, but in addition to this, the jacks 54 capable of adjusting the heights of the individual lifting jacks are added to adjust 10 mm to 20 mm. Finally, the height-adjusting jack 54 capable of adjusting 100 mm is mounted to keep on the safe side.

Besides, the loads added to the center hole type lifting jacks 16 are monitored by the central control board 76, but if the pressure of the oil entered into the center hole type lifting jack 16 jacking up by 500 mm is monitored, the load is fluctuated to vary the load balance because the incoming oil (flowing oil) is a moving oil between the jacks by the actuation. In the present embodiment, the oil of the height-adjusting jack 54 in itself is not moving and it is the stable pressure, so the pressure is picked by a pressure transducer to convert it into an electrical signal, and it is inputted to an operation board to be monitored, and when it becomes, for example, 15% or more compared to the initial setting value of the load, there is a function to adjust the loads by each center hole type lifting jack 16 to have a function to keep the initial load balance when it is lifted up from the ground. It is therefore possible to lift the boiler module 10 with a good balance without adding too much or too small load to the center hole type lifting jacks 16.

Incidentally, the initial setting load may be updated arbitrary. In a lifting construction method of the boiler module 10, attendant equipments are attached to the boiler module 10 on the ground one after another, to enlarge a ground work process as much as possible. The jack-up is performed during this process, and therefore, the shared loads of the respective center hole type lifting jacks 16 are fluctuated by the attendant equipments. It becomes possible to make the load balance at a final lifting process appropriate by resetting and updating the setting shared load every time when the shared load is fluctuated.

What is claimed is:

1. A load balance adjusting method of lifting jacks with a central control unit, when a lifting module is jacked up by a plurality of lifting jacks via suspending rods, comprising:

detecting a load of each of the plurality of lifting jacks jacking up respective suspending rods coupled to the lifting module;

sending detected loads of the plurality of lifting jacks to the central control unit;

calculating a setting shared load; and adjusting a height of a respective one of the plurality of lifting jacks when a fluctuation of a respective detected load relative to the setting shared load exceeds a prescribed range, to adjust to the setting shared load.

2. The load balance adjusting method of the lifting jacks according to claim 1, wherein the setting shared load is a detected value of a stable pressure of a hydraulic jack for adjusting the height of the lifting jack.

3. The load balance adjusting method of the lifting jacks according to claim 1, wherein the setting shared load is a value in which the shared loads of the respective lifting jacks are averaged when the lifting module is lifted up from the ground by using the plural lifting jacks.

4. A load balance adjusting equipment of a lifting jack, when a lifting module is jacked up by using a plurality of lifting jacks via suspending rods, comprising:

a plurality of adjusting jacks, a respective adjusting jack of the plurality of adjusting jacks being capable of adjusting an installation height of a respective lifting jack;

a load detecting means detecting a lifting load of the lifting jack by a hydraulic force of said adjusting jack; and a control means capable of adjusting a height of the lifting jack by said adjusting jack based on a setting shared load and a detected load of the lifting jack, wherein the control means includes a central control unit receiving the detected load of each of the plurality of lifting jacks and calculating the setting shared load.

5. The load balance adjusting equipment of the lifting jack according to claim 4, wherein the lifting jack and said adjusting jack of height are constituted by center hole type jacks disposed concentrically.

6. The load balance adjusting equipment of the lifting jack according to claim 4, wherein said control means controls the lifting jacks in a group unit by grouping several lifting jacks in one group.

7. A jack-up equipment, comprising:

a plurality of height-adjusting jacks of a center hole type capable of changing an installation height of a respective one of a plurality of lifting jacks at a lower portion of the respective lifting jack of the center hole type jacking up a lifting module via a suspending rod;

a detecting means detecting a pressure of a hydraulic chamber inside each of said height adjusting jacks;

respective data output units sending respective detected hydraulic pressures to a central control unit; and a supplying/draining means of a pressure oil, wherein:

the detected hydraulic pressures correspond to respective detected loads on respective height-adjusting jacks;

the central control unit calculates and stores a setting shared load for the plurality of height-adjusting jacks; and a height adjustment of each of the lifting jacks is enabled by a raising/lowering of said respective height-adjusting jack by said supplying/draining means of the pressure oil based on the respective detected hydraulic pressures and the calculated setting shared load.

* * * * *